United States Patent [19]

Kägi et al.

[11] Patent Number: 4,890,359

[45] Date of Patent: Jan. 2, 1990

[54] APPARATUS FOR MONITORING LAP FORMATION ON A ROLL FOR GUIDING A TEXTILE SLIVER

[75] Inventors: Beat Kägi, Oberuzwil; Peter Oswald, Matzingen, both of Switzerland

[73] Assignee: Rieter Maschinenfabrik AG, Winterthur, Switzerland

[21] Appl. No.: 294,719

[22] Filed: Jan. 9, 1989

[30] Foreign Application Priority Data

Jan. 11, 1988 [CH] Switzerland ..... 00074/88

[51] Int. Cl.[4] ..... D01H 5/60

[52] U.S. Cl. ..... 19/265

[58] Field of Search ..... 19/0.2, 0.23, 258, 259, 19/260, 261, 262, 265, 271, 273

[56] References Cited

U.S. PATENT DOCUMENTS

| | | | |
|---|---|---|---|
| 2,359,820 | 10/1944 | Solanas | 19/262 |
| 3,311,958 | 4/1967 | Nivens, et al. | 19/0.23 |
| 4,413,178 | 11/1983 | Mandl et al. | 19/258 |

FOREIGN PATENT DOCUMENTS

| | | | |
|---|---|---|---|
| 0062185 | 2/1986 | European Pat. Off. | 19/258 |
| 3137346 | 4/1983 | Fed. Rep. of Germany | 19/258 |

*Primary Examiner*—Werner H. Schroeder

*Assistant Examiner*—Douglas E. Price

*Attorney, Agent, or Firm*—Werner W. Kleeman

[57] ABSTRACT

The apparatus monitors lap formation at a pair of rolls guiding a slubbing or sliver in a drafting arrangement for spinning machines. In the event of a lap or coil forming, for example, on a pressure roll, a piston rod of a piston is shifted away until a switching element touches a contact edge or region of a switching sleeve. A cylinder housing encircling the switching sleeve and otherwise electrically separated from the piston is thus short-circuited with the piston. Since the switching sleeve and piston are separately connected to a control unit, a switching function is effected in the control unit by this short-circuit and the drafting arrangement is thereby stopped. The switching sleeve is slidably guided on a guide rod mounted at an upper part in such a manner that the frictional resistance is greater than the weight of the switching sleeve. The electrical separation between the cylinder housing and the piston is rendered possible in that a slide bush and a lid-shaped end or closure part each consist of electrically insulating material. If for some reason the pressure roll must be reground so that its diameter is reduced the switching sleeve is automatically shifted further by the lid-shaped end or closure part so that the switching distance or travel always remains essentially constant.

27 Claims, 8 Drawing Sheets

APPARATUS FOR MONITORING LAP FORMATION ON A ROLL FOR GUIDING A TEXTILE SLIVER

BACKGROUND OF THE INVENTION

The present invention relates to a new and improved apparatus for monitoring lap or coil formation or the like on a roll of a pair of rolls guiding a slubbing or sliver in a textile machine, especially a spinning machine, comprising pressing means for pressing one or a first roll against a second roll or a sliver-guiding element moved in analogous manner.

In an apparatus as know to the art, for example, from European Patent No. 0,062,185, published Feb. 26, 1986, and its cognate U.S. Pat. No. 4,413,378, granted Nov. 8, 1983, pressure rolls are pressed at both ends thereof by means of pneumatic cylinders against the drive rolls in order to produce the required clamping force between the pressure rolls and the drive rolls.

In the event of lap formation or coiling occurring either on the pressure roll or on the drive roll, the pressure cylinder moves back in a direction opposite to the direction of pressing.

In combination with drafting arrangements or systems of this kind, it is known to detect any receding or reverse movement of the pressure roll by means of suitable and appropriately arranged limit switches and to thus stop the drafting arrangement or system.

It is also known that pressure rolls of this kind have to be ground from time to time at their cylindrical surface guiding the slubbing or sliver in order to remove grooves forming therein as a result of the drafting operation. This grinding operation reduces the diameter of the pressure rolls, so that the contact travel to the aforementioned limit switch increases such that the lap or coil forming on the pressure roll or on the drive roll has to be of a larger diameter if it is to stop the drafting arrangement.

It is further known that limit switches of this type can be manually moved in order to maintain the aforementioned switching travel within the required limits to some extent.

However, shifting the limit switches in this way depends, on the one hand, on the operator's reliability and dexterity and requires, on the other hand, reliable determination of the new diameter of the roll.

SUMMARY OF THE INVENTION

Therefore, with the foregoing in mind it is a primary object of the present invention to provide a new and improved construction of an apparatus for monitoring lap or coil formation or the like on a roll guiding a textile sliver or the like which does not suffer from the aforementioned drawbacks and shortcomings of the prior art constructions.

Another and more specific object of the present invention aims at the provision of a new and improved construction of an apparatus for monitoring lap formation or coiling on a roll guiding a slubbing or sliver, which apparatus is not limited to use in drafting rolls, but can be applied to all pairs of rolls guiding or carrying fiber assemblies or the like, in which the diameter of at least one roll of such a pair or rolls has to be reduced in the course of use.

Yet a further significant object of the present invention aims at providing a new and improved apparatus for reliably monitoring lap formation on a roll guiding a slubbing or sliver and which apparatus is relatively simple in construction and design, and highly reliable in operation.

Now in order to implement these and still further objects of the invention, which will become more readily apparent as the description proceeds, the apparatus of the present invention is manifested by the features that, among other things, there is provided at least one switching means for stopping the drive roll of the pair of rolls, such switching means being structured to be actuated by the pressing means for pressing the pressure roll against the drive roll. The pressing means have a predetermined pressure stroke in a predetermined pressing direction and a predetermined contact-making travel in a predetermined switching direction. The contact-making travel remains essentially constant irrespective of the length of the predetermined pressure stroke.

The contact-making travel in the predetermined switching direction is adjustable such that the contact-making travel remains essentially constant independent of the diameter of the drive roll and the pressure roll, respectively.

In this way, firstly, the contact-making travel need not be adjusted by an operator and, secondly, the contact-making travel remains at all times set to the optimum value.

In an advantageous construction of the invention, the pressing means comprises a pressure piston operatively associated with the pressure roll and serving to press the latter against the drive roll.

It is particularly advantageous that the at least one switching means comprises a pair of switching elements provided for the pressure piston operatively associated with the pressure roll. The switching elements comprise a first switching element and a second switching element arranged in a spaced relationship which constitutes the predetermined contact-making travel.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
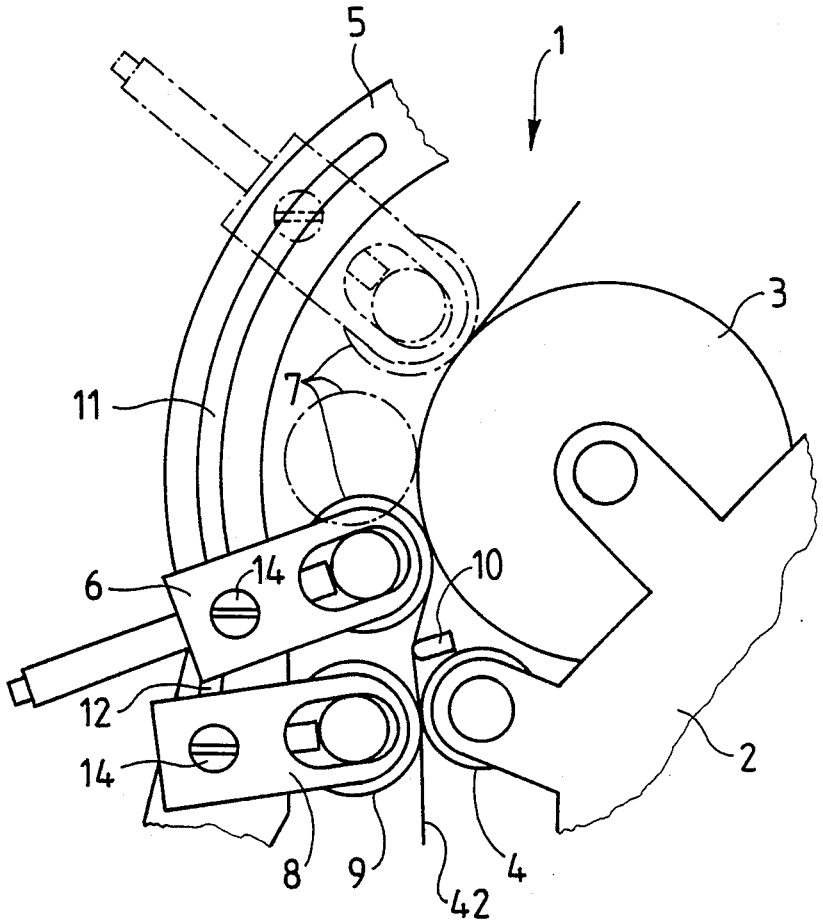
FIG. 1 is a side view of a section of a drafting arrangement of the kind disclosed in the aforementioned European Patent No. 0,062,185 and its cognate U.S. Pat. No. 4,413,378, viewed in the axial direction of the rolls.

Describing now the drawings, it is to be understood that to simplify the showing thereof, only enough of the structure of the apparatus for monitoring lap formation or coiling on a roll or roller has been illustrated therein as is needed to enable one skilled in the art to readily understand the underlying principles and concepts of the present invention. Turning now specifically to FIG. 1 of the drawings, a part or section of a drafting arrangement 1 illustrated therein by way of example and not limitation, will be seen to comprise a machine frame 2 at which drive rolls or rollers 3 and 4 are each rotatably and drivably supported. Two interconnected swing yokes 5 or the like, of which only one is shown and then only partially, belong to the drafting arrangement 1 and are used for displaceable mounting of two pressure-roll holders 6, only one of which is shown in FIG. 1, to each receive a pressure or press roll 7, and two pressure-roll holders 8, again only one of which is shown in FIG. 1, to each receive a pressure or press roll 9.

Depending on the type of drafting arrangement 1, a roving, slubbing or sliver passes between the pressure rolls 7 and 9 and the drive rolls 3 and 4. In the case of the aforementioned drafting arrangement 1 the fiber material is assumed to be a fiber sliver 42.

A pressure rod or bar 10 is also provided for further guidance of the sliver 42 or the like between the two pairs of rolls or rollers 3,7 and 4,9 in FIG. 1.

Guide slots or tracks 11 and 12, respectively, are each provided in the two interconnected swing yokes 5 for displaceable mounting of the pressure-roll holders 6 and 8, respectively. Only one each of the pressure-roll holders 6 and 8 has been shown in FIG. 1.

Figure 2:
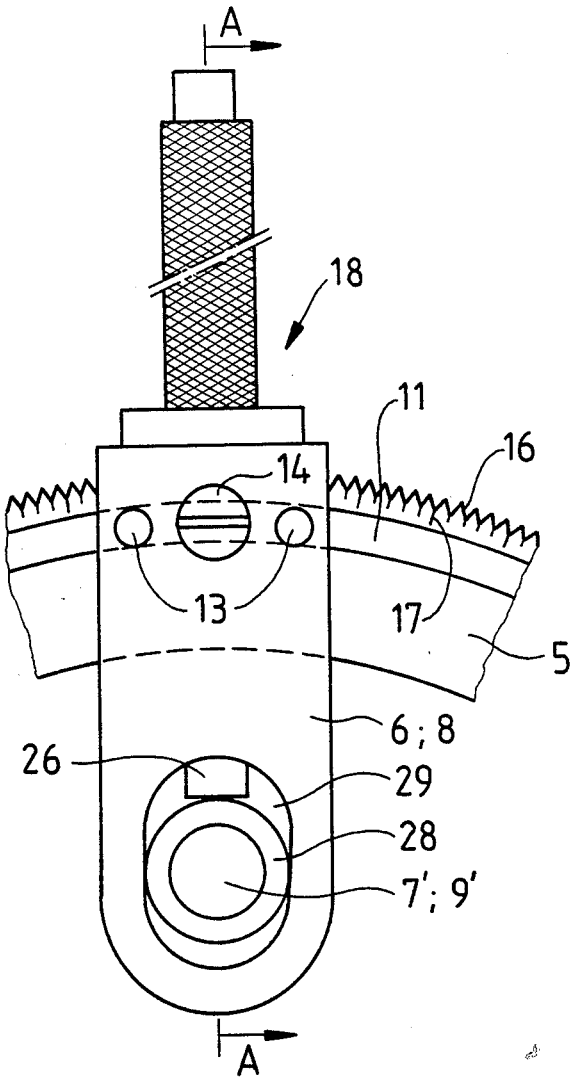
FIG. 2 illustrates a part of the section of the drafting arrangement according to FIG. 1, shown on an enlarged scale and in greater detail.
Figure 3:
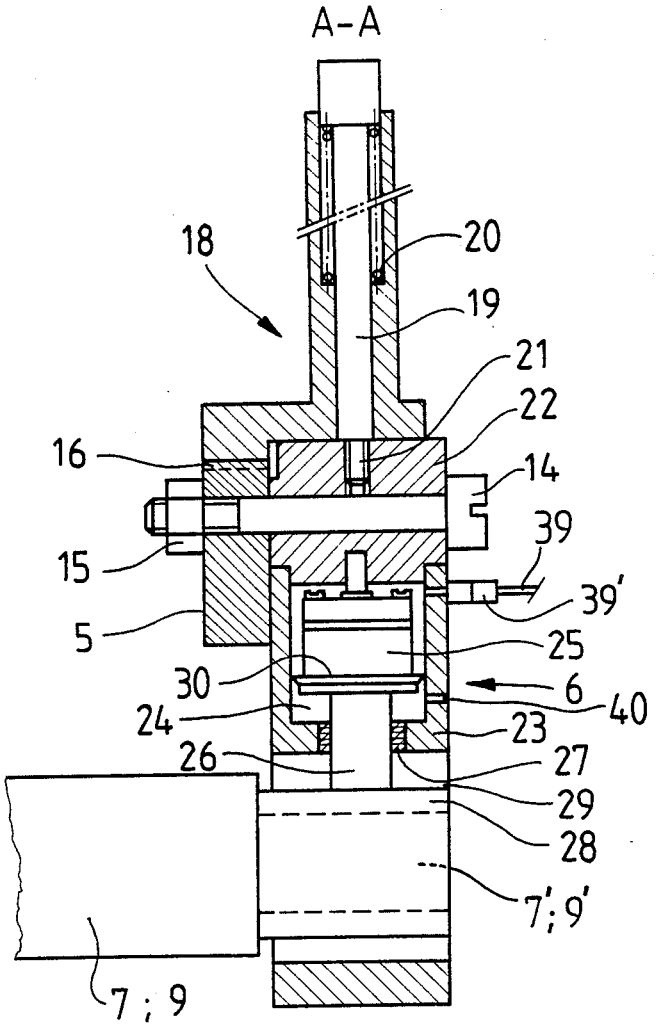
FIG. 3 illustrates a detail of FIG. 2, partially shown in sectional view along the line A—A of FIG. 2 and depicting a first exemplary embodiment of the apparatus constructed according to the invention.

As will be seen from FIGS. 2 and 3, two guide pins 13 are provided for each pressure-roll holder 6 and 8 to guide the pressure-roll holders 6 and 8, respectively, and a threaded bolt or screw 14 with a corresponding nut 15 is provided for fixing purposes.

As will be seen particularly from FIG. 2, the swing yoke 5 or the like has a toothed or latching detent means 16 with a detent scale 17. A detent part or region 18 engages in the toothed detent means 16 and, in turn, comprises ratchet or ratcheting teeth not particularly shown or referenced in the drawings.

The difference between the pressure-roll holder 6 and the pressure-roll holder 8 is that the pressure-roll holder 8 does not have a detent part 18 and is thus not moved in functional relationship to the toothed detent means 16.

As already stated, the pressure rolls 7 and 9, respectively, are each held at their two ends in a pressure-roll holder, i.e. the pressure-roll holders 6 and 8, respectively, are arranged in mirror image relationship at the two ends of the pressure rolls or rollers 7 and 9 in the swing yoke 5.

To enable the pressure-roll holder 6 to be displaced along the guide slot or track 11, the detent part 18 is guided by a guide pin or pin member 19 and pressed against the toothed detent means 16 by means of a compression spring 20. The guide pin 19 is secured in the pressure-roll holder 6 by means of an associated screw or threaded extension 21. Each pressure-roll holder 6 and 8, respectively, comprises a top or upper part or portion 22 and a bottom or lower part or portion 23.

Figure 4:
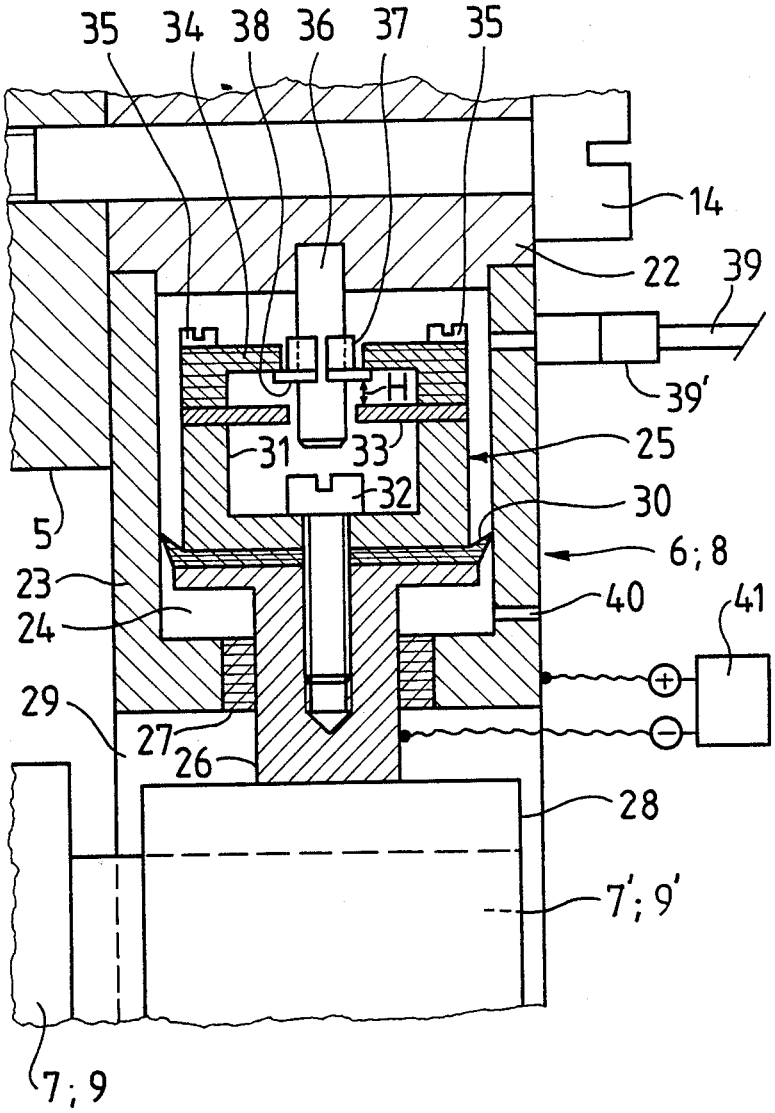
FIG. 4 illustrates, on an enlarged scale, a portion of the detail of FIG. 3, partially shown in sectional view through the first exemplary embodiment of the apparatus constructed according to the invention.
Figure 11:
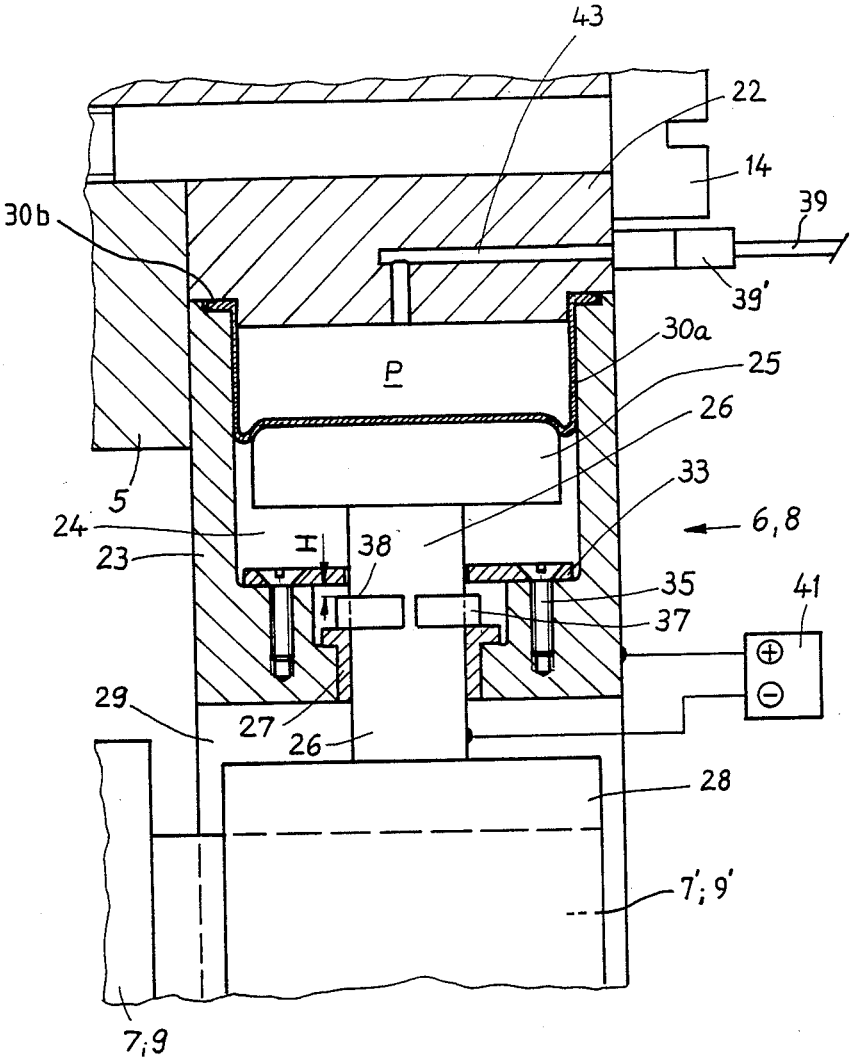
FIG. 11 illustrates a fourth exemplary embodiment of the apparatus constructed according to the invention, partially shown in sectional view and constituting an alternative embodiment to that shown in FIG. 4.

As will be seen from FIGS. 3, 4 and 11, the pressure-roll holders 6 and 8 are constructed as cylinder units each having a cylinder chamber or cavity 24. A piston 25 is guided in this cylinder chamber or cavity 24 by a piston rod 26 in an electrically insulating liner or slide bush or bushing 27.

A bearing 28 receiving journals 7' and 9' of the pressure rolls 7 and 9, respectively, extends in a passage aperture or opening 29 of the pressure-roll holders 6 and 8, respectively. The piston rod 26 presses against the bearing 28 to produce the previously mentioned pressure or pressing force or action between the pressure rolls 7 and 9, respectively, and the drive rolls 3 and 4, respectively.

FIG. 4 illustrates a section through the piston or piston member 25 and shows that a diaphragm 30 or the like divides the cylinder chamber or cavity 24 in terms of the pressure conditions. This diaphragm 30 is pressed against the piston rod 26 by a substantially pot-shaped piston part or portion 31 by means of a screw or threaded bolt 32.

A substantially disc-shaped or discoidal switching element 33 is connected to the pot-shaped piston part or portion 31 by a substantially lid-shaped end or closure part 34 and the associated threaded bolts or screws 35. The lid-shaped end or closure part 34 is composed or electrically non-conductive material.

A guide rod or bar 36 is also fixedly mounted in the top or upper part or portion 22 coaxially with respect to the piston rod 26. This guide rod or bar 36 serves to receive or support a switching sleeve or sleeve member 37 slidable thereon.

The switching sleeve 37 comprises a contact edge or region or rim 38 which determines the freedom of movement or mobility of the switching sleeve 37 between the disc-shaped switching element 33 and the lid-shaped end or closure part 34.

To generate the pressure in the top part or portion of the cylinder chamber or cavity 24 divided by the diaphragm 30 as shown in FIG. 4, this top part or portion is structured to receive, for instance, compressed air by means of a compressed air connection or line 39. Instead of a pneumatic medium, there also can be used a suitable hydraulic medium. The bottom part or portion of the cylinder chamber or cavity 24 is vented by a venting bore or port 40.

The disc-shaped switching element 33 is electrically connected to a control unit 41 via the pot-shaped piston part or portion 31, screw or threaded bolt 32 and piston rod or rod member 26, and the same applies to the switching sleeve 37 via the top or upper part or portion 22 and the bottom or lower part or portion 23, so that the switching sleeve 37 can perform a switching function in conjunction with the disc-shaped switching element 33.

FIG. 11 illustrates another exemplary embodiment in which the switching sleeve 37 and the substantially disc-shaped switching element 33 are located outside or externally of a pressure chamber P, unlike the construction shown in FIG. 4. The disc-shaped switching element 33 is coaxially arranged with respect to the piston rod 26 and directly mounted on the bottom or lower part or portion 23 by means of screws or threaded bolts 35.

The switching sleeve 37 is frictionally held on the piston rod or rod member 26, the switching sleeve contact edge or rim 38 defining, in normal operation, a distance I from the disc-shaped switching element 33. The piston rod 26 passes through an electrically insulating liner or slide bush or bushing 27 in the bottom or lower part 23.

A diaphragm or membrane 30a or the like is secured at a clamping surface 30b between the top or upper part or portion 22 and the bottom or lower part or portion 23. This diaphragm 30a rests on the end face or surface of the piston or piston member 25 and transmits to such piston or piston member 25 the pressure generated in the pressure chamber or compartment P. To generate this pressure, the pressure chamber or compartment P can receive, for instance, compressed air via a bore or channel 43 provided in the top or upper part 22 by means of the compressed air connection or line 39.

The disc-shaped switching element 33, on the one hand, is electrically connected to a control unit 41 via the bottom part 23, and the switching sleeve 37, on the other hand, is also so connected via the piston rod 26, such that the switching sleeve 37 can perform a switching function in conjunction with the disc-shaped switching element 33.

In operation, after fiber material, such as a roving or sliver has been trained or guided over the bottom or drive rolls 3 and 4 and deflected over the pressure rod or bar 10, the swing yoke or bracket 5 is swung into the working or operative position shown in FIG. 1, in which position it is appropriately fixed so that the pressure rolls or rollers 7 and 9 can press the roving or sliver against the bottom or drive rolls 3 and 4, respectively.

This pressure or pressing action is obtained, on the one hand, by the piston rod 26 resting on the corresponding bearing 28 and, on the other hand, in that the top part or portion of the cylinder chamber or cavity 24 located above the diaphragm or membrane 30 is subjected to positive pressure by means of a change-over or switching valve 39' of the compressed air connection or line 39.

In the event of a lap or coil forming on the pressure roll 7 or 9 or on the drive or bottom roll 3 or 4, the corresponding pressure roll is moved away from the oppositely situated or facing drive or bottom roll against the resistance of the piston 25, so that the latter is moved upwards as viewed in FIGS. 4 and 11 until the disc-shaped switching element 33 touches or contacts the switching sleeve 37. The aforedescribed switching function is thus performed, so that instantaneous stoppage of the drafting arrangement 1 is effected by the control unit 41.

The distance H or I, as the case may be, between the disc-shaped switching element 33 and the contact edge or rim 38 of the switching sleeve 37 corresponds to the switching or contact-making travel of the piston or piston member 25. At the same time, this distance H or I essentially corresponds to the thickness of the lap or coil that has formed.

It is therefore conceivable that this distance H or I should be made as small as possible in order to stop the drafting arrangement 1 as rapidly as possible in the event of any lap or coil formation or the like.

Accordingly, the switching voltage must not have high magnitudes or values if arcing is to be avoided between the disc-shaped switching element 33 and the switching sleeve 37 even in the case of a very small or short distance H or I.

If, for any known operational reason, the pressure roll 7 or 9 has to be reground at the surface carrying or guiding the roving or sliver or the like, the diameter of this pressure roll 7 or 9 is inevitably reduced.

On the other hand, the swing yoke or bracket 5 is always fixed in the same operational position independently of such diameter reduction, so that when pressure is applied the piston or piston member 25 automatically moves further towards the bearing 28 by an amount equal to half the difference in the diameter of the reground pressure roll 7 or 9. During this follow-up or advanced movement the switching sleeve 37 is also automatically moved down or forward by the same amount on the guide rod 36 by means of the lid-shaped end or closure part 34 (FIG. 4), or alternatively, the sleeve 37 moves up or backward on the piston rod 26 via the liner or slide bush 27 (FIG. 11). The distance H or I is thus automatically adjusted to the desired or required value upon each regrinding of the pressure roll or roller 7 or 9.

If the switching sleeve 37 is to be pushed or shifted down, as considered when viewing FIG. 4, only in the aforedescribed case and not when the swing yoke or bracket 5 lifts away, then it is possible to discontinue the force on the piston 25 before lifting away of the swing yoke or bracket 5 takes place, this being effected by venting of the pressure chamber on the pressure side of the diaphragm or membrane 30. A similar procedure can be adopted in the construction shown in FIG. 11.

Figure 5:
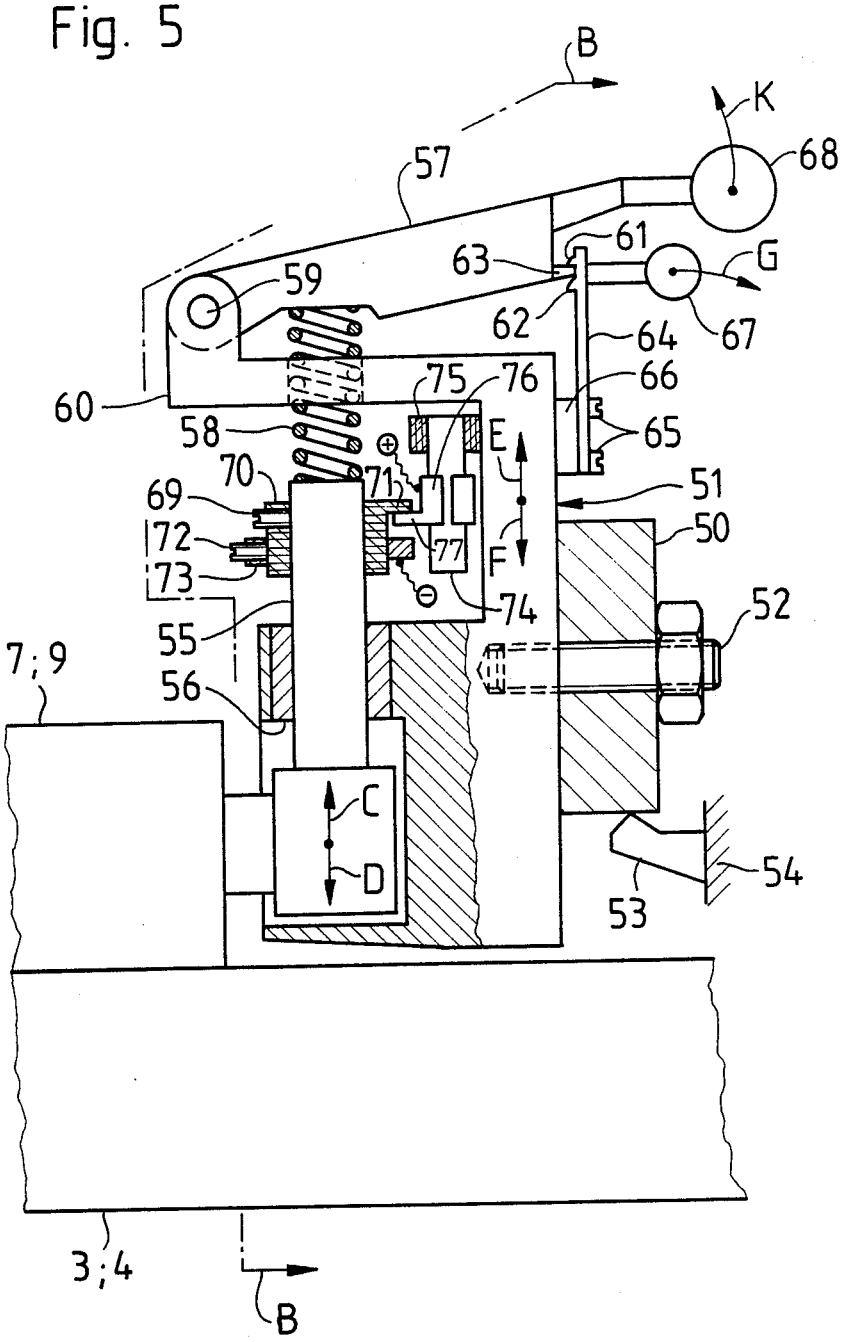
FIG. 5 illustrates a second exemplary embodiment of the apparatus constructed according to the invention, partially shown in sectional view.
Figure 6:
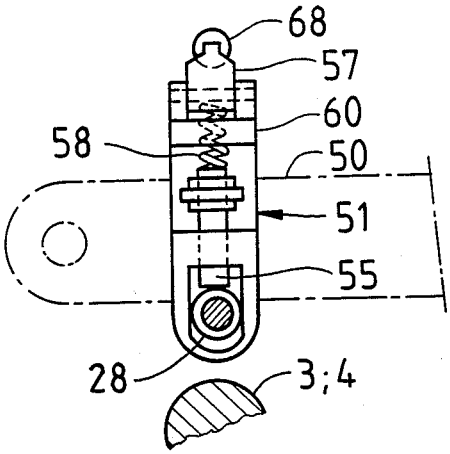
FIG. 6 is an elevational view of the second exemplary embodiment of the apparatus according to FIG. 5 depicted on a reduced scale and taken along the line B—B in FIG. 5.

FIGS. 5 and 6 show a mechanical solution for performing basically the same functions as that shown and described with reference to FIG. 4, so that the same reference characters have been generally used to denote the same or analogous components.

In FIGS. 5 and 6, a pressure-roll holder 51 is secured by a screw or threaded bolt 52 to a yoke 50, the bearing 28 of the pressure roll or roller 7 and 9 being guided in manner known in the pressure-roll holder 51 so that movements can be carried out substantially only in the directions C and D.

On the other hand, the pressure-roll holder 51 together with the swing yoke or bracket 50 can be lifted upwards in the direction E or lowered in the direction F, so that the pressure rolls 7 and 9, respectively, can be brought into contact with the drivable drive or bottom rolls 3 and 4, respectively.

The swing yoke 50 and hence the pressure-roll holder 51 always reach or assume the same operating position as a result of bearing against a stop or abutment 53 in the operating position. This stop 53 is secured at a stationary machine part 54.

To enable pressure to be exerted on the pressure-roll bearing 28, a pressure piston or piston member 55 is provided in a guide bearing 56 recessed in the pressure-roll holder 51, and on which pressure piston 55 a pressing lever or lever member 57 exerts pressure by means of a compression spring 58 located between the pressing lever 57 and the pressure piston 55.

On the one hand, the pressing lever 57 is pivotably mounted by means of a pivot or hinge pin 59 in a carrier or support arm 60 secured to the swing yoke 50. On the other hand, the operating position of the pressing lever 57 is fixed by detent lugs or dogs 61 and 62, respectively. An extension or protuberance 63 provided at the pressing lever 57 engages in these lugs or dogs 61 and 62, respectively. The reason for providing the two lugs or dogs 61 and 62 will be explained hereinafter.

The lugs or dogs 61 and 62 are, in turn, provided on a spring element 64 secured to the swing yoke or bracket 50 by means of the screws 65. To avoid the spring element 64 bearing directly against the swing yoke 50, an intermediate member 66 is provided between the spring element 64 and the swing yoke 50.

The spring element 64 can be swung away in the direction of the arrow G by means of a handle 67 or the like secured at the spring element 64, so that the detent lugs 61 and 62, respectively, no longer fix the position of the pressing lever 57 and this pressing lever 57 can swing away in the direction of the arrow K as a result of the spring force exerted by the compression spring 58 or the like. On the other hand, in order to swing the pressing lever 57 back into the working or operating position, a handle 68 or the like is fixed on the pressing lever 57.

In FIG. 6, the swing yoke 50 is extended as shown in dot-dash lines to the left and right of the solid-line drawing in order, on the one hand, to represent the pivotability of this swing yoke 50 and, on the other hand, to show that it is possible to provide not just one pressure-roll holder 51 for each swing yoke 50 but, in accordance with the number of pressure rolls 7 and 8 respectively, a corresponding number of pressure roll-holders 51 for a corresponding length of the swing yoke 50.

Furthermore, the piston or piston member 55 bears a displaceable shifting element 70 which is lockable by means of a locking screw 69 or the like and on which a displacement lug or nose 71 is provided. The shifting element 70 also bears a displaceable contact ring 73 which is lockable by means of a locking screw 72. Furthermore, a guide rod 74 is secured to the swing yoke or bracket 50 by means of a carrier or support element 75 composed of insulating material. This guide rod or rod member 74 serves to receive a contact sleeve or sleeve member 76 which is disposed on the guide rod 74 for displacement in such a manner that the friction between the guide rod 74 and the contact sleeve 76 is such that the contact sleeve 76 is not displaceable or shifted by its own weight.

A contact lug or dog 77 is provided on the contact sleeve or sleeve member 76 and is located between the displacement lug 71 and the displaceable contact ring 73. The contact sleeve 76 is connected, for example, to a positive electrical terminal or pole and the contact ring 73 to a negative electrical terminal or pole of a suitable power supply. These two terminals or poles, which are shown purely diagrammatically, are connected, as shown in FIG. 4, to an electrical control unit like the electrical control unit 41 shown in FIG. 4.

In operation, the pressing lever 57 is held in the working or operating position by the detent lug 61 or 62 as shown in FIG. 5. The extension 63 bears against the detent lug 61 when the pressure rolls 7 and 8, respectively, still have the original diameter, while the extension 63 bears against the other detent lug 62 when the pressure rolls 7 and 9, respectively, have been reduced in diameter by a predetermined amount in order to eliminate the known occurring operational wear.

It should be obvious that any number of detent lugs may be provided, the number being determined solely by the nature of the detent means or the strength thereof.

If lap formation or coiling occurs at the pressure rolls 7 or 9, respectively, or at the driven bottom or drive rolls 3 or 4, respectively, the associated piston 55 is pushed back against the force of the compression spring 58 so that contact is established between the displaceable contact ring 73 and the contact lug 77 as soon as the lap or coil thickness achieves a value corresponding to the contact-making distance between these two elements 73 and 77. This distance is not particularly shown in FIG. 5.

Before the swing yoke 50 is lifted away from the stop or abutment 53, the operator releases the locking of the pressing lever or lever member 57 by means of the handle 67 so that the compression spring 58 is released.

If the friction between the pressure piston 55 and the guide bearing 56 is so chosen that the pressure piston 55 does not move down by its own weight after the swing yoke 50 has been lifted, the displacement lug 71 and thus the contact sleeve 76 again reach the position shown in FIG. 5 after the pressing lever 57 has been re-positioned into its working or operating position.

If, however, for known reasons of wear the pressure rolls 7 or 9, respectively, are reduced in diameter, the associated displacement lug 71 displaces the contact sleeve 76 downwards, as considered when viewing FIG. 5, when the pressing lever 57 is locked in its operating position, until the pressure rolls 7 and 9, respectively, bear on the bottom or drive rolls 3 and 4, respectively. The original magnitude or value of the distance between the contact lug 77 and the displaceable contact ring 73 is thus maintained.

Instead of the above-described friction selected or provided between the pressure piston 55 and the guide bearing or bearing member 56 in order to prevent displacement of the pressure piston 55 by the action of its own weight, a not particularly illustrated compression spring of given length can be provided between the displaceable shifting element 70 and the guide bearing 56, its spring force being sufficient to prevent downward movement. This also applies if the friction between the piston rod 26 and the electrically insulating lever or slide bush 27 shown in FIG. 4 is not sufficient to prevent the piston 25 from moving downwards by its own weight.

Figure 7:
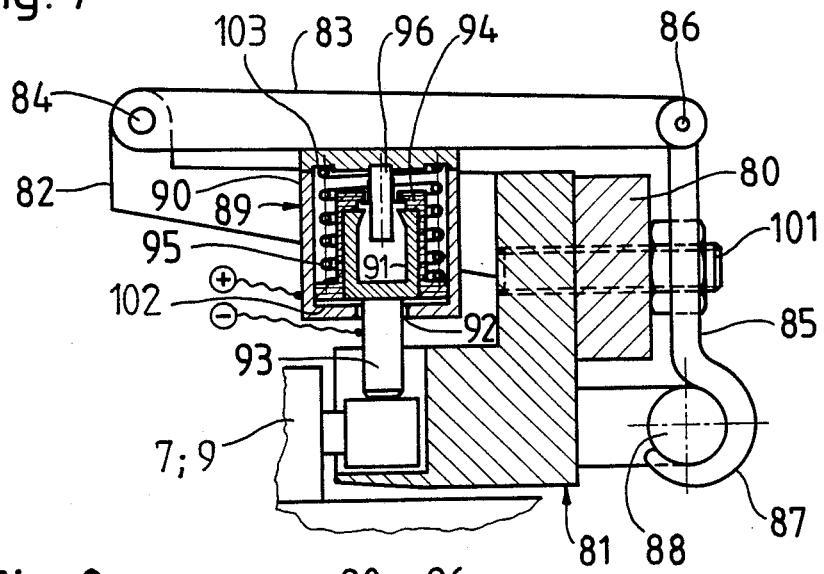
FIG. 7 illustrates a third exemplary embodiment of the apparatus constructed according to the invention, partially shown in sectional view.
Figure 9:
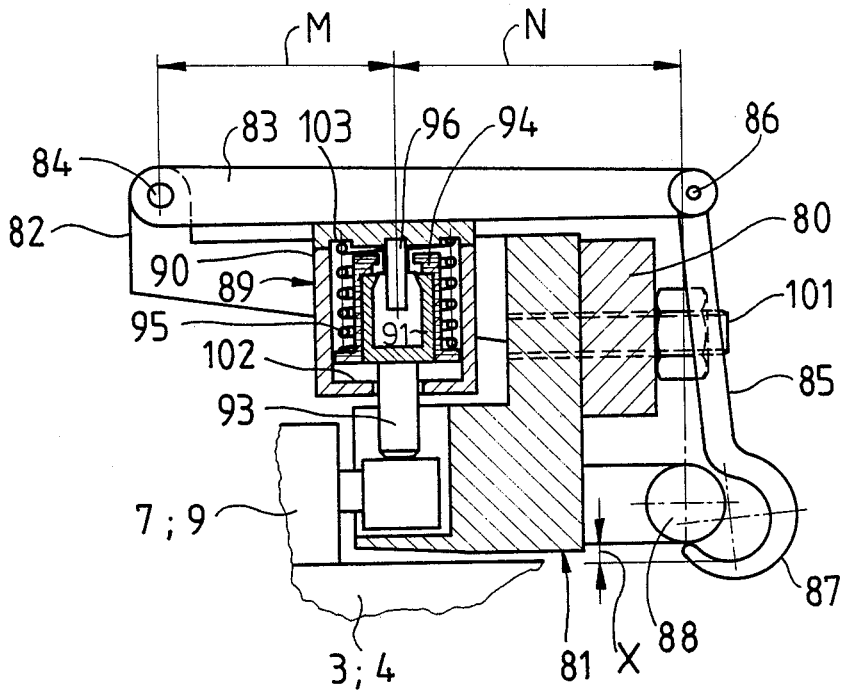
FIG. 9 shows the apparatus of FIG. 7 in a different operating state or position.
Figure 10:
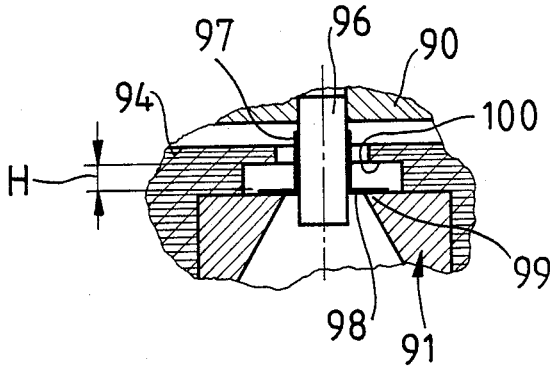
FIG. 10 shows the detail of FIG. 8 in the operative state corresponding with that of the apparatus in FIG. 9.

FIGS. 7 and 9 show further applications of the inventive principle, in the embodiments of which the same reference characters have been generally used to denote the same or analogous components.

One or more pressure-roll holders 81, corresponding to the number of pressure rolls or rollers, are each secured by a screw or threaded bolt 101 to a swing yoke or bracket 80. The pressure-roll bearings 28 are guided in the pressure-roll holders 81 in the manner already described, except that the pressure rolls can be removed from the pressure-roll holders 81 in upward direction, as considered when viewing FIGS. 7 and 9.

Two carrier or support arms 82 are also fixed on the pressure-roll holder 81. Only the rear one is shown in FIGS. 7 and 9. A pressing lever 83 is pivotally secured at these carrier or support arms 82 by a pivot or hinge joint 84.

For positioning the pressing lever 83 in the working or operating position, a fixing hook or hook member 85 is arranged to pivot by means of a pivot or hinge joint or pin 86 at the free end of the pressing lever 83 and in the working or operating position, its hooked part 87 engages a bracket or yoke 88 or the like secured to the pressure-roll holder 81, this engagement being play-free for a predetermined amount.

Furthermore, a pressing element 89 is secured to the pressing lever 83 to exert pressure on the bearing 28 in order to press the pressure rolls 7 and 9, respectively, against the bottom or drive rolls 3 and 4, respectively, in the operating position. This pressing element 89 comprises a housing 90 fixed at the pressing lever 83 and containing a displaceably mounted pressure piston 91. This pressure piston 91 comprises a piston rod 93 guided by means of an electrically non-conductive guide bearing 92 recessed in the housing 90, the free end of the piston rod 93 exerting the aforesaid pressure on the bearing 28.

A sleeve or sleeve member 94 of electrically non-conductive material engages positively around the pressure piston 91 such that a compression spring 95 also provided in the housing 90 and bearing at one end against the sleeve 94 and at the other end against a housing rear or back wall 103, with the spring pressure being exerted on the sleeve 94 in the direction of the bearing 28, can transmit its force to the pressure piston 91 via the sleeve 94.

Also mounted in the housing 90 is a guide rod 96 on which a contact sleeve 97 is displaceably arranged. The friction between the contact sleeve 97 and the guide rod 96 is such that although the contact sleeve 97 is displaceable, it is not displaced by its own weight. The contact sleeve 97 in turn has a contact flange or flange member 98 which in operation is located at a distance H from a contact nose 99 belonging to the pressure piston 91.

If a lap or coil forms on the pressure rolls 7 or 9, respectively, or on the bottom or drive rolls 3 or 4, respectively, during operation, then the associated bearing 28 is raised, as considered when looking at FIG. 7, so that the contact nose 99 touches or contacts the contact flange 98 of the contact sleeve 97. Since the piston rod 93 is connected, for example, to a negative terminal or pole and the housing 90 to a positive terminal or pole of a suitable power supply, and these two terminals or poles are associated with a control unit such as the control unit 41 shown in FIG. 4, when the contact nose 99 contacts the contact flange 98, the result is the establishment of an electrical contact or closing of an electrical circuit which, for example, stops the drafting arrangement 1 by means of the control unit like the control unit 41 of FIG. 4.

To enable the lap or coil to be removed, the pressing lever 83 must be swung upwards, for which purpose this pressing lever 83 is initially pressed downwards, against the force of the compression spring 95, until the hooked part or hook 87 can be swung away from the bracket or yoke 88.

As a result, the compression spring 95 is, of course, able to move the pressure piston 91 downwards as far as housing base 102, so that the contact sleeve 97 is also moved downwards. This latter displacement takes place by means of a projection or extension 100 on the sleeve 94, such projection 100 engaging and displacing the contact flange 98 of the contact sleeve 97.

As a result of the displacement of the pressure piston 91 as far as the housing base 102, the contact sleeve 97 is moved downwards through too great a distance, so that contacted would undesirably occur between the contact flange 98 and the contact nose 99 simply as a result of the pressing lever 83 pivoting into the working or operating position.

Figure 8:
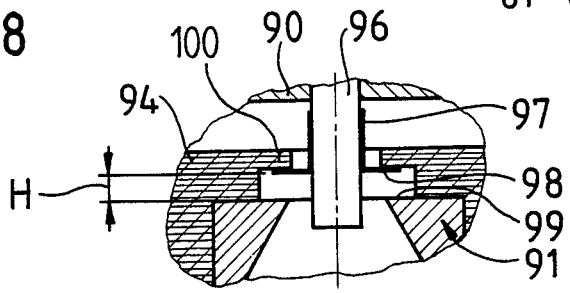
FIG. 8 illustrates a detail of the apparatus according to FIG. 7, shown on an enlarged scale and partially in section.

To obviate this, the hooked part or hook 87 has a throat depth X as shown in FIG. 9 so that upon pivoting of the pressing lever 83 into the working or operating position, the pressing lever 83 has to be pivoted downwards by a greater amount X than is necessary for the working or operating position, so that the contact sleeve 97 is again pushed back into its working or operating position on the guide rod 96, in which position the distance H shown in FIG. 8 is guaranteed.

This assurance occurs, however, only if the ratios of the lever lengths M and N (FIG. 9) coincide with the ratios H and X. The correct position of the contact flange 98 occurs when the following equation applies.

$$X \geqq H \times \frac{M+N}{M}$$

Since the swing yoke or bracket 80 rests on a stationary stop or abutment (not shown), the swing yoke 80 and hence also the pressure-roll holder 81 always have the same working or operating position.

If, for one of the reasons indicated hereinbefore, the diameter of the pressure rolls 7 or 9, respectively, is reduced, the distance H automatically is established for the aforesaid reasons when the fixing hook 85 pivots into the operating position such that contact-making is guaranteed, even with a reduced pressure-roll diameter, with a lap or coil of the same height or thickness as with a pressure-roll diameter of the original size.

The field of application illustrated for the invention is not confined to the drafting arrangement shown in FIGS. 1 to 3. On the contrary, the invention can be used wherever a fiber structure or mass of fiber material is carried or guided by two rolls or by one roll and another element guiding the fiber structure, and at least one roll is reduced in diameter for the aforesaid reasons.

Finally, it should be stated that it is known from general practice for the pressure rolls 7 and 9, respectively, to have a rubber covering or sheath, so that as far as the electrical circuit is concerned there is a separation between the machine ground or earth and piston rods 26 and 93, respectively, (FIGS. 4, 7 and 9, respectively), even if no steps are taken to respectively insulate the pressure-roll holders 6 and 8 and the pressing element 89 from ground. Alternatively, it is possible to provide an electrically insulating element at the free end of the pressure pistons 26 and 93 to transmit the pressure force of the pressure piston to the bearing 28.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. An apparatus for monitoring lap formation on a roll of a pair of rolls guiding a fiber sliver in a textile machine, comprising:

a drive roll;

a pressure roll;

said pressure roll being arranged in cooperating relationship with said drive roll;

said drive roll and said pressure roll defining said pair of rolls;

means for pressing said pressure roll against said drive roll;

at least one switching means for stopping said drive roll in the event of lap formation on one roll of said pair of rolls;

means for supporting said pressure roll together with said pressing means and said at least one switching means;

said supporting means serving to lift said pressure roll away from said drive roll;

said at least one switching means being actuated by said pressing means;

said pressing means having a predetermined pressure stroke in a predetermined pressing direction and a predetermined contact-making travel in a predetermined switching direction; and said predetermined contact-making travel in said predetermined switching direction remaining substantially constant irrespective of the length of said predetermined pressure stroke in said predetermined pressing direction.

2. The apparatus as defined in claim 1, wherein:

said drive roll has a predetermined diameter;

said pressure roll has a predetermined diameter; and means for adjusting said predetermined contact-making travel in said predetermined switching direction in such a manner that said predetermined contact-making travel remains substantially constant independent of said predetermined diameter of at least one of said rolls.

3. The apparatus as defined in claim 2, wherein:

said pressing means comprise a pressure piston coacting with said pressure roll of said pair of rolls; and said pressure piston serving to press said pressure roll against said drive roll.

4. The apparatus as defined in claim 3, wherein:

said at least one switching means comprises a pair of switching elements provided for said pressure piston;

said pair of switching elements comprising a first switching element and a second switching element arranged in spaced relationship to each other; and said spaced relationship constituting said predetermined contact-making travel in said predetermined switching direction of said pressure piston.

5. The apparatus as defined in claim 4, further including:

guide means;

said first switching element in coating operative relationship with said pressure piston;

said second switching element being arranged at said guide means so as to be displaceable in said predetermined switching direction;

said adjusting means lockingly positioning said second switching element at a predetermined position at said guide means; and said predetermined switching direction being substantially axially parallel to said pressure piston.

6. The apparatus as defined in claim 5, wherein:

said first switching element is arranged to be displaceable and lockable for setting said predetermined contact-making travel.

7. The apparatus as defined in claim 5, wherein:

a displacement element provided at said pressure piston for displacement of said second switching element arranged at said guide means.

8. The apparatus as defined in claim 5, wherein:

said second switching element is lockable by means of friction prevailing between said second switching element and said guide means.

9. The apparatus as defined in claim 8, wherein:

said guide means constitute a guide bolt; and said second switching element comprises a switching sleeve guided by said guide bolt.

10. The apparatus as defined in claim 7, wherein:

said guide means constitute a piston rod of said pressure piston; and said second switching element comprising a switching sleeve guided by said piston rod.

11. The apparatus as defined in claim 3, wherein:

said at least one switching means comprises a pair of switching elements provided for said pressure piston;

said pair of switching elements comprising a first switching element and a second switching element arranged in spaced relationship to one another;

said spaced relationship defining said predetermined contact-making travel in said predetermined switching direction;

said first switching element being in coacting operative relationship with said pressure piston;

said second switching element being arranged to be displaceable in substantially parallel relationship to said pressure piston; and said second switching element being lockable in at least one predetermined position.

12. The apparatus as defined in claim 11, wherein:

said first switching element is arranged to be displaceable and lockable for setting said predetermined contact-making travel.

13. The apparatus as defined in claim 11, wherein:

said second switching element is coaxially lockable on said pressure piston by means of friction.

14. The apparatus as defined in claim 11, further including:

means for pneumatically actuating said pressure piston by application of a pneumatic force.

15. The apparatus as defined in claim 11, further including:

means for hydraulically actuating said pressure piston by application of a hydraulic force.

16. The apparatus as defined in claim 5, further including:

spring means for actuating said pressure piston by application of a spring force.

17. The apparatus as defined in claim 14, further including:

control means for selectively maintaining said pneumatic force during operation and for cancelling said pneumatic force before lifting off said pressure roll.

18. The apparatus as defined in claim 15, further including:

control means for selectively maintaining said hydraulic force during operation and for cancelling said hydraulic force before lifting off said pressure roll.

19. The apparatus as defined in claim 16, further including:

control means for selectively maintaining said spring force during operation and for cancelling said spring force before lifting off said pressure roll.

20. The apparatus as defined in claim 17, wherein:

said control means comprise a pneumatic change-over valve.

21. The apparatus as defined in claim 18, wherein:

said controlling means comprise a hydraulic change-over valve.

22. The apparatus as defined in claim 19, further including:

a pressing lever;

said control means comprising a compression spring provided between said pressing lever and said pressure piston; and releasable arresting means retaining said pressing lever in an operating position.

23. The apparatus as defined in claim 14, further including:

a cylinder arranged in cooperating relationship with said pressure piston;

said cylinder defining a cylinder chamber;

said pressure piston of said cylinder having a piston rod;

said pressure piston limiting a pressure chamber in an upper part of said cylinder chamber and being guided in said cylinder chamber by said piston rod;

said pressure chamber being connected to said pneumatically actuating means; and said pair of switching elements being disposed within said pressure chamber in which said pneumatic force is transmitted to said pressure piston.

24. The apparatus as defined in claim 15, further including:

a cylinder arranged in cooperating relationship with said pressure piston;

said cylinder defining a cylinder chamber;

said pressure piston of said cylinder having a piston rod;

said pressure piston limiting a pressure chamber in an upper part of said cylinder chamber and being guided in said cylinder chamber by said piston rod;

said pressure chamber being connected to said hydraulically actuating means; and said pair of switching elements being disposed within said pressure chamber in which said hydraulic force is transmitted to said pressure piston.

25. The apparatus as defined in claim 14, further including:

a cylinder arranged in cooperating relationship with said pressure piston;

said cylinder defining a cylinder chamber;

said pressure piston of said cylinder having a piston rod;

a diaphragm limiting a pressure chamber in an upper part of said cylinder chamber and transmitting said pneumatic force to said pressure piston guided in said cylinder chamber by said piston rod;

said pressure chamber being connected to said pneumatically actuating means; and said pair of switching elements being disposed in a region located externally of said pressure chamber.

26. The apparatus as defined in claim 15, further including:

a cylinder arranged in cooperating relationship with said pressure piston;

said cylinder defining a cylinder chamber;

said pressure piston of said cylinder having a piston rod;

a diaphragm limiting a pressure chamber in an upper part of said cylinder chamber and transmitting said hydraulic force to said pressure piston guided in said cylinder chamber by said piston rod;

said pressure chamber being connected to said hydraulically actuating means; and said pair of switching elements being disposed in a region externally of said pressure chamber.

27. An apparatus for monitoring lap formation on a roll of a pair of rolls guiding a fiber sliver in a drafting arrangement for a spinning machine, comprising:

a drive roll;

a pressure roll;

said pressure roll being arranged in cooperating relationship with said drive roll;

said drive roll and said pressure roll defining said pair of rolls;

means for pressing said pressure roll against said drive roll;

at least one switching means for stopping said drive roll in the event of lap formation on one roll of said pair of rolls;

means for supporting at least said pressure roll;

said supporting means serving to lift said pressure roll away from said drive roll;

said at least one switching means being actuated by said pressing means;

said pressing means having a predetermined pressure stroke in a predetermined pressing direction and a predetermined contact-making travel in a predetermined switching direction; and said predetermined contact-making travel in said predetermined switching direction remaining substantially constant irrespective of the length of said predetermined pressure stroke in said predetermined pressing direction.

* * * * *